United States Patent [19]

Buisker

[11] 4,160,517

[45] Jul. 10, 1979

[54] WEB ALIGNING APPARATUS FOR MULTI-LEVEL WEB MATERIAL

[75] Inventor: Raymond A. Buisker, Rockford, Ill.

[73] Assignee: Rockford Servo Corporation, Rockford, Ill.

[21] Appl. No.: 868,046

[22] Filed: Jan. 9, 1978

[51] Int. Cl.[2] ..... B65H 25/26

[52] U.S. Cl. ..... 226/19; 226/23; 226/45

[58] Field of Search ..... 26/74, 76; 226/18, 19, 226/21, 22, 23, 45; 73/37.7

[56] References Cited

U.S. PATENT DOCUMENTS

| | | | |
|---|---|---|---|
| 3,079,805 | 3/1963 | Rojecki | 226/23 X |
| 3,494,011 | 2/1970 | Cohn et al. | 26/76 X |
| 3,504,835 | 4/1970 | Callan | 226/23 |
| 3,569,642 | 3/1971 | Grover | 26/76 X |

FOREIGN PATENT DOCUMENTS

| | | | |
|---|---|---|---|
| 951754 | 7/1974 | Canada | 226/18 |

*Primary Examiner*—David A. Scherbel

*Attorney, Agent, or Firm*—Morsbach & Pillote

[57] ABSTRACT

A web aligning apparatus for use with multi-level web material such as carpeting, tufted fabrics and the like having a backing web and a pile on the backing web inwardly of a side edge of the backing web. The web aligning apparatus includes a pile engaging member mounted at a sensing location along the course of travel of the web for movement along a first path crosswise of the course of web travel and generally parallel to the face of the web at the sensing location to sense lateral deviations of the course of travel of the pile edge from a preselected position. The pile engaging member is also mounted for movement along a second arcuate path generally tangent to the web from a first position extending alongside the web backing at the sensing location toward a second position displaced along the arcuate path in the direction of travel of the web when the pile engaging member rides onto the pile. A first motion detector detects movement of the pile engaging member along the first path and a second motion detector detects movement of the pile engaging member along the second arcuate path.

12 Claims, 5 Drawing Figures

W
W1
W2
W3
X
D
2
31
31a
32
33
34
35
36
37
38
41
42
43
51
52
53
54
55
60
101
101a
101b
101c
102
103
104
105
106
107
108
108a
109
109a
111
112
113
116
117
118
119
120
125
126
127
127a
128
129
131
131a
132
181
182

WEB ALIGNING APPARATUS FOR MULTI-LEVEL WEB MATERIAL

BACKGROUND OF THE INVENTION

In a web aligning apparatus for multi-level web material such as carpeting, tufted fabrics and the like having a backing web and pile on the backing web spaced inwardly from the edge of the backing web, it is frequently desirable to maintain the edge of the pile in a preselected relation to an apparatus which operates on the web, independent of the lateral position of the edge of the backing web. This necessitates sensing the line of juncture between the backing web and the pile and this poses some problem if the backing web is such that it is not possible to pass either an air stream or a light beam through the backing web to sense the edge of the pile.

The U.S. Pat. No. 3,244,418 to Henderson discloses an electrical pile edge sensing apparatus which utilizes a plurality of contact fingers, some of which normally rest on the pile and others of which normally rest on the backing adjacent the pile, and which contact fingers operate switches to control positioning of the pile edge in accordance with the relative positions of the contact fingers. Such pile edge sensing apparatus, however, can only effect a step-type control and the pile edge can shift laterally a significant distance before one of the contact fingers either rides onto or off of the pile to change the electrical signal.

U.S. Pat. No. 3,935,979 owned by the assignee of the present application discloses a web aligning apparatus for use with multi-level web material in which the sensing apparatus included a gap-type pneumatic sensor, a pile engaging member mounted for movement along a first path crosswise of the course of travel of the web at the sensing location and generally parallel to the plane of the web to sense lateral deviations of the course of travel of the pile edge and also along a second path generally perpendicular to the plane of the web at the sensing location to sense when the pile engaging member rides onto the pile, and a vane connected to the pile engaging member for movement therewith in the gap to vary the signal produced by the sensor in response to movement of the web engaging member along either the first or the second paths. Thus, in this prior apparatus, the same sensor sensed both motion of the pile engaging member in a direction paralleling the plane of the web and laterally of the pile edge and motion of the pile engaging member perpendicular to the plane of the web, and adjustment of the device to enable a single sensor to properly sense both motions of the pile engaging member, was somewhat critical. Moreover, while the prior pile edge sensing apparatus worked well in applications where the web was traveling generally horizontally with the pile upright at the sensing location, it was difficult to adapt it for use in applications where the web was not traveling generally horizontally, for example where the web was traveling vertically or where the pile face of the web was inverted at the sensing location. Further, since the pile engaging member was supported for movement along two relatively perpendicular paths that were both perpendicular to the path of travel of the web, the pile engaging member could not readily absorb impact forces acting in a direction paralleling the course of travel of the web at the sensing location, such as would occur when a seam or other discontinuity in the web struck the web engaging member.

SUMMARY OF THE INVENTION

It is the general object of the present invention to provide an improved web aligning apparatus for multi-level web material having a single pile engaging member and separate detecting means for detecting when the pile engaging member is moved laterally by the pile edge and when the pile engaging member rides on top of the pile.

Another object of this invention is to provide a web aligning apparatus for multi-level web material in which the pile engaging member is mounted for movement along a first path laterally of the pile edge and is also mounted for movement along a second arcuate path generally tangent to the course of travel of the web at the sensing location when the pile engaging member either rides onto the pile or is contacted by a seam in the web.

Another object of this invention is to provide a web aligning apparatus for multi-level web material which can operate when mounted in various different attitudes relative to the horizontal to enable sensing of the pile edge of the web not only when the web is traveling horizontally with the pile upright but also when the web is traveling in a more or less vertical direction or is inverted at the sensing location.

A further object of the invention is to provide a web sensing apparatus having means for sensing when the pile engaging member contacts a seam or the like and for preventing correction of the course of travel of the web until after the seam is passed.

These, together with other objects and advantages of the present invention will be more readily understood by reference to the following detailed description when taken in connection with the accompanying drawings wherein.

Figure 1:
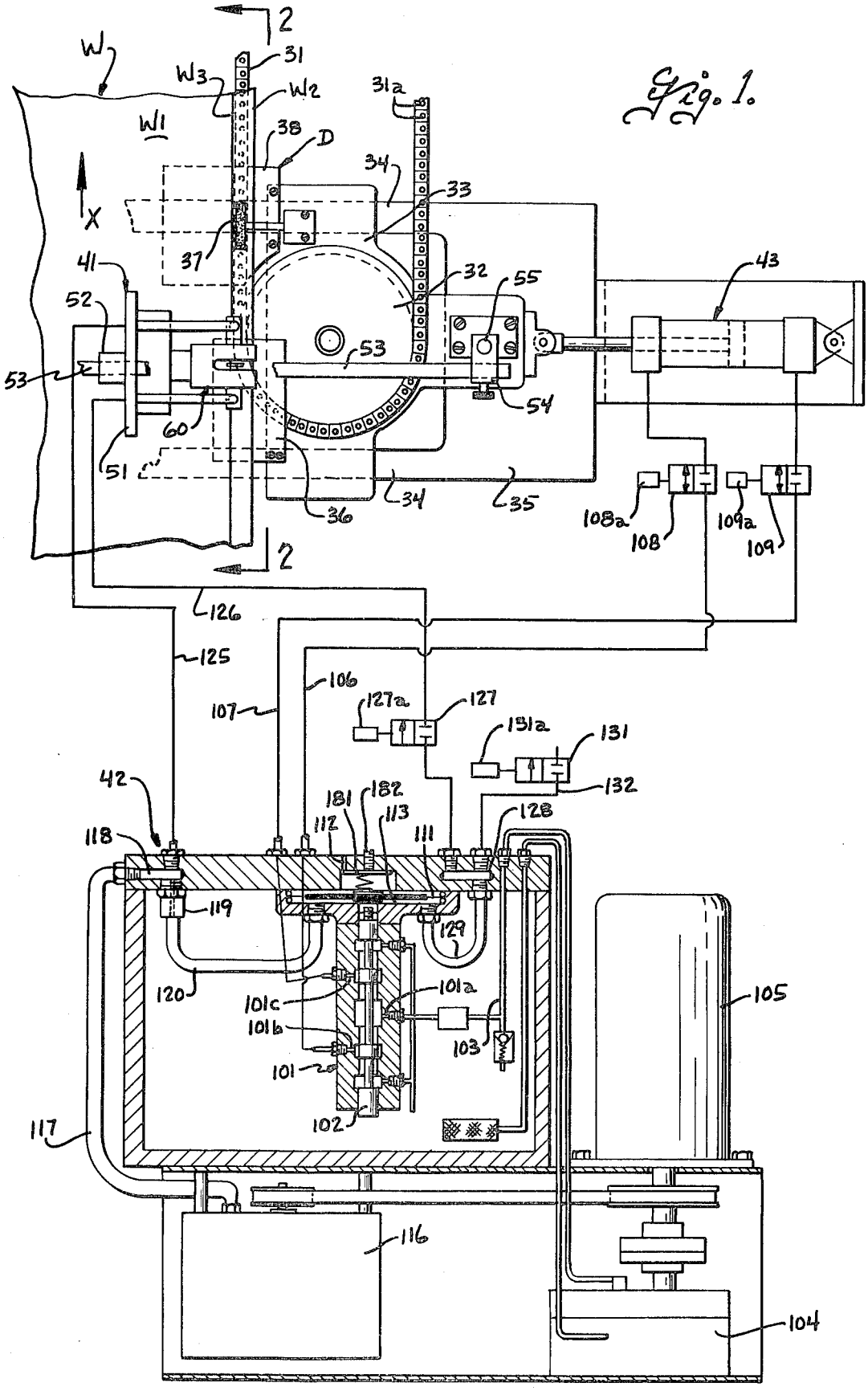
FIG. 1 is a diagrammatic view illustrating a web aligning apparatus for multi-level material and embodying the improved pile edge sensing apparatus of the present invention.

The web aligning apparatus is adapted for use with multi-level web material W such as carpeting, tufted fabrics and the like wherein the face web W1 formed by the tufts or pile is spaced inwardly from the side edge of the backing web W2 and defines a discreet step or pile edge W3 at the line of juncture between the pile and the backing web. In the handling of such multi-level web materials, it is frequently desired to maintain the pile edge W3 of the face web, that is the side edge of the line of pile in a carpet or the like, in a preselected course of travel relative to a device such as designated generally by the letter D which operates on the web. The web aligning apparatus may be arranged for operation as a web chasing system in which the web aligning apparatus automatically shifts the device D laterally to the web W in a direction to maintain the device D in a preselected lateral position relative to the pile edge W3 or, alternatively, may be used in a web guiding system in which the web W is laterally shifted relative to the device D to maintain the pile edge W3 in a preselected position laterally relative to the device D. The web aligning apparatus is diagrammatically shown in FIG. 1 applied to a tenter frame of known construction. Such tenter frames in general include elongated chains designated 31 having means such as tenter clamps or pins 31*a* for engaging the web edge. In FIG. 1, one tenter chain is shown for one side of the web W, it being understood that a similar tenter chain is also provided for the other side edge of the web. The inlet ends of the tenter chains are entrained over sprockets 32 which are rotatively driven by a suitable means (not shown) and which sprockets are rotatably supported on a movable support structure 33. The support structure is guided as by guideways 34 on a stationary support structure 35 for movement in a direction crosswise of the course of travel of the web, which course is designated by the arrow X. The web W, as it enters the tenter frame, is guided by inlet guide plate 36 disposed at a level above the tops of the pins 31*a* on the tenter chain 31 and, after the web passes the inlet sprocket, it is pressed downwardly as by a roller or brush 37 onto the pins 31*a*. A means such as a guide plate 38 underlies the web W in the region where the web is pressed onto the tenter pins to support the web. As shown, the guide plate 38 and the roller 37 are conveniently supported on the movable support structure 33 for movement therewith laterally of the web. While the web alignment apparatus is herein shown applied to a shiftable tenter frame, it is to be understood that the device D which operates on the web W can be of different forms and may, for example, be a tuft dye or tuft printing apparatus.

The web alignment apparatus in general includes a sensor 41 for sensing the lateral position of the pile edge or step W3 between the face W1 and the backing web W2; a control system 42 which responds to the signal produced by the sensor 41 and which reversibly controls application of power to an actuator 43 which operates to relatively shift the web W and the device D in a direction to maintain the pile edge in a preselected course of travel relative to the device D.

Figure 2:
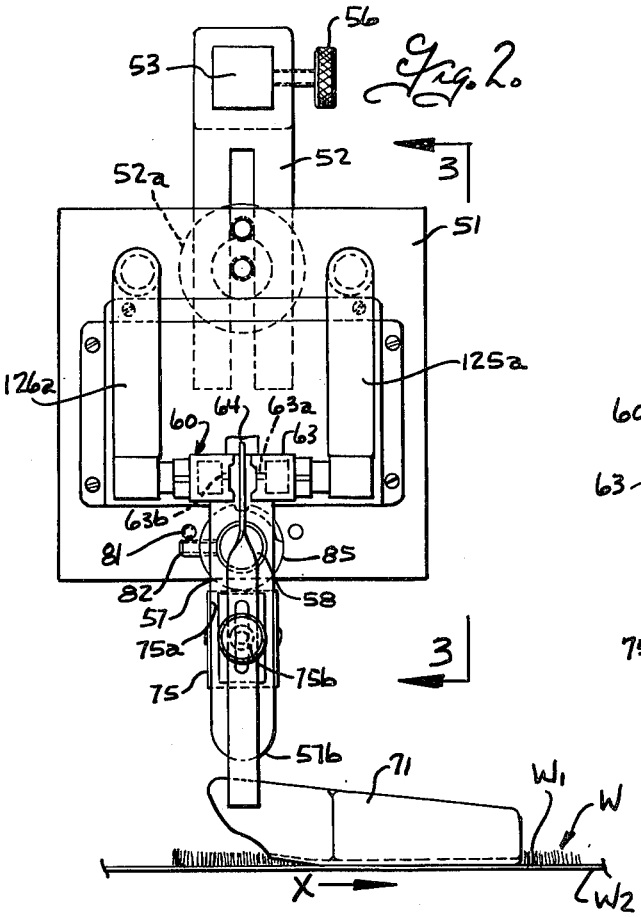
FIG. 2 is a front elevational view of the pile edge sensing apparatus taken on the plane 2—2 of FIG. 1 and illustrating the sensing apparatus on a larger scale than FIG. 1.

The pile edge sensor 41 is adapted to be mounted at a sensing location along the course of travel of the web and includes a main or primary support 51 that is mounted as by a bracket 52 on a support bar 53. In the web chasing system illustrated, the support bar 53 is, in turn, mounted by a bracket 54 and post 55 (FIG. 1) on the movable support structure 33 for movement therewith so that the web sensor 42 moves laterally of the device D that operates on the web. Alternatively, in a web guiding system wherein the device D that operates on the web is mounted at a laterally fixed location and the web is shifted laterally relative to the device D, then the support bar 53 would be similarly mounted on a laterally fixed location. The web sensor 42 is adjustable along the bar 53 to adjust the position of the web sensor in a direction crosswise of the course of web travel and is locked in its adjusted position by a hand nut 56 (FIG. 2). The main support 51 is also adjustable relative to the bracket 52 in a direction perpendicular to the face of the web at the sensing location, as by a hand nut 52*a*.

The pile edge sensor 41 includes a pile engaging member 71 adapted to engage the pile edge W3 and mounted for movement along a first path crosswise of the course of web travel and generally parallel to the face of the web at the sensing location to sense movement of the pile edge laterally of the course of travel of the web, and the pile engaging member is also mounted for movement along a second arcuate path generally tangent to the course of travel of the web to sense when the web engaging member rides on top of the pile. For this purpose, a sensor support member 57 is mounted on the main support 51 for pivotal movement relative thereto about an axis crosswise of the course of travel of the web and generally parallel to and spaced from the face of the web at the sensing location. In the embodiment shown, a pintle 58 has a reduced diameter portion 58*a* at one end threaded into the main support 51 to be non-rotatably supported thereby with the pintle extending generally parallel to the plane of the web and transverse to the course of web travel. The sensor support member 57 is rotatably supported on the pintle by a sleeve 59 and is retained in axial position thereon by a head 58*b* at the outer end of the pintle.

The web engaging member is mounted on the sensor support member 57 for movement therewith about the axis of the pintle 58 and also for movement relative thereto along a path crosswise of the course of travel of the pile edge and generally parallel to the plane of the web to sense lateral deviations of the course of travel of the pile edge from a preselected lateral position. In the embodiment illustrated, the web engaging member is slidably and non-rotatably supported by rectilinear guide means 73 on the sensor support member 57 for movement relative thereto along a path parallel to the axis of the pintle 58. The rectilinear guide means is conveniently in the form of a pair of guide rods that are slidably supported in preferably anti-friction bearing means 74 on the sensor support member. The web engaging member 71 is mounted on the lower end of an arm 76 and the arm is non-rotatably mounted on a head 75 at one end of the guide rod 73 so that the web engaging member can move in an arcuate path about the axis of the pintle 58. The web engaging member is advantageously supported for limited adjustment in a direction perpendicular to the plane of the web. As shown, the arm 76 is slidable in guide ways 75*a* on the head 75 and adapted to be adjustably secured thereto by a hand nut 75*b*.

A first motion detector 60 is provided for detecting movement of the pile engaging member along a first path crosswise of the course of web travel and generally paralleling the face of the web at the sensing location. The first motion detector includes detector body 63 mounted on the support member 57 for movement therewith about the axis of pintle 58, and a movable detector member 64. In the embodiment illustrated, the first motion detector is a gap-type pneumatic sensor having a transmitting orifice 63*a* in a leg at one side of the gap and a sensing orifice 63*b* in a leg at the other side of the gap, and the movable detector member 64 comprises a vane which is movable in the gap to variably interrupt the stream of air from the transmitting orifice to the sensing orifice and to vary the pressure conditions at the latter. The detector body 63 is fixedly mounted on the support member 57 as by bolts 65 so that the sensor body moves as a unit with the support member about the axis of the pintle 58.

Figure 3:
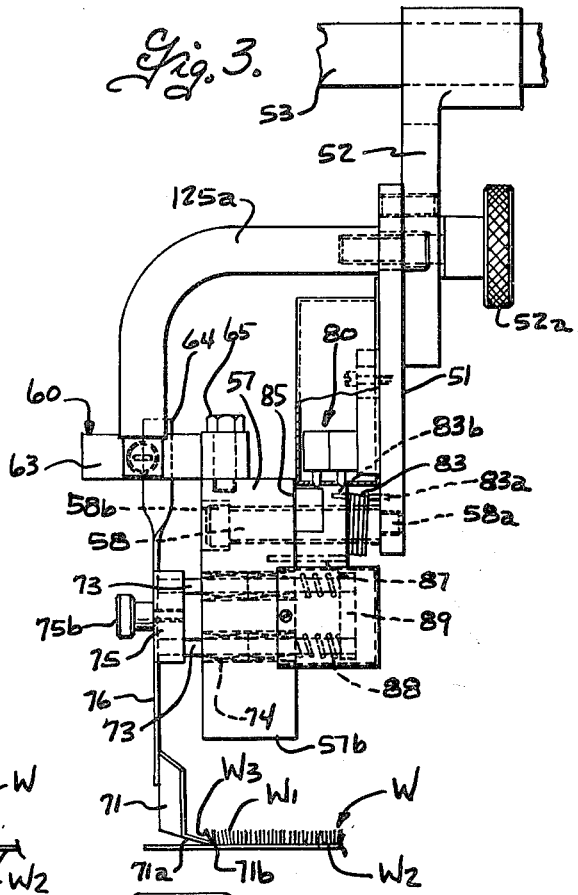
FIG. 3 is a side elevational view of the sensing apparatus taken on the plane 3—3 of FIG. 2.

The arm 76 is connected to the movable detector member or vane 64 and, as shown, is conveniently integral with the vane so that the vane moves with the pile engaging member 71 and relative to the detector body 63 when the web engaging member is moved laterally of the course of travel of the web by the pile edge. The web engaging member is also adapted to move about the axis of the pintle 58 in an arcuate path generally tangent to the course of travel of the web at the sensing location, when the web engaging member rides on top of the pile or when the web engaging member engages a discontinuity such as a seam in the web. However, since the first motion detector 60 including the detector body 63 and movable detector member 64 also pivot about the axis of the pintle 58, movement of the web engaging member above the axis of the pintle does not change the signal at the first motion detector 60. A second motion detector 80 is provided for sensing when the web engaging member moves with the support member 57 about the axis of the pintle 58. As best shown in FIG. 3, the pile engaging member 71 is formed with a relatively wide blade portion 71*a* disposed at a shallow angle with respect to the plane of the web and having a lengthwise extending edge 71*b* paralleling the path of travel of the web and adapted to engage the pile edge adjacent this juncture with the backing web. The inlet end of the blade 71*a* is curved laterally outwardly as viewed in plan from the edge 71*b* to guide stray tufts or pile laterally toward the lengthwise guide edge 71*b*, and the inlet end of the blade 71 is curved upwardly as viewed in side elevation shown at 71*c*, to guide the web to the underside of the portion 71*a*.

As previously described, the web engaging member is movable about the axis of the pintle 58 in an arcuate path generally tangent to the path of web travel, and the web engaging member is normally positioned as shown in FIG. 2 extending alongside the web backing W2. A stop means including a pin 81 is mounted on the main support 51 to engage a pin 82 on the support member 57 to limit movement of the latter in one direction above the pivot axis when the web engaging member reaches a position shown in FIG. 2. The web engaging member is yieldably biased toward the position shown in FIG. 2 by a coil-type torsion spring 83 (FIG. 3) which is disposed around the pintle 58 and has one end 83*a* anchored on the support 51 and the other end 83*b* anchored in a cam member 85. The cam member 85 is disposed around the pintle 58 and is non-rotatably connected to the sensor support member 57 for turning movement therewith as by a pin 87 (FIG. 3). The spring 83 thus yieldably biases the support member 57 and hence the pile engaging member 71 in a clockwise direction as viewed in FIG. 2 to its normal position shown in FIG. 2 with the pin 82 engaging the stop pin 81. The pile engaging member 71 is pivotal around the pintle 58 in an arcuate path from its normal position shown in FIG. 2 extending alongside the web at the sensing location, toward a second position displaced along the arcuate path in the direction of travel of the web, when the pile engaging member either rides on top of the pile on the web or is engaged by an obstruction such as a seam in the web. The pile engaging member is also yieldably biased in a direction crosswise of the path of web travel toward the pile edge and, as shown in FIG. 2, coil-type compression springs 88 are interposed between the sensor support member 57 and an abutment 89 on the guide rods 73.

The second motion detector detects when the pile engaging member moves along the arcuate path out of its normal position. The second motion detector includes a first cam surface or cam 85 diagrammatically shown at 85*a* in FIG. 5 for operating an actuator 91 when the pile engaging member moves through a preselected angle, for example five degrees from its normal position shown in FIG. 2, and which movement is indicative of the motion of the pile engaging member produced when the pile engaging member begins to ride on top of the pile. The cam 85 also advantageously includes a second cam surface diagrammatically shown at 85*b* in FIG. 5, and which is arranged to operate an actuator 92 when the movement of the pile engaging member along the arcuate path exceeds a preselected range, for example thirty degrees, as would occur when the pile engaging member is contacted by a cross-seam or other discontinuity in the web.

The control apparatus 42 is arranged to respond to the signal from the first motion detector 63 produced by movement of the pile engaging member in a direction crosswise of the path of web travel, to operate the actuator 43 in a manner to maintain the pile edge in a preselected lateral position relative to the device that operates on the web. The control apparatus 42 is also arranged to operate the actuator 43 in response to movement of the second motion detector 80 produced when the pile engaging member moves along the arcuate path from its normal position, to relatively shift the web and the device that operates on the web in a direction to cause the pile engaging member to move outwardly of the pile on the web. The control apparatus 42 diagrammatically shown in FIG. 1 is conveniently of the type disclosed in the U.S. Pat. No. 3,407,706 to Robert W. Ott, Jr. issued Oct. 29, 1968, and reference is hereby made to that patent for a more complete description of the control apparatus. In general the actuator 43 is reversibly operated under the control of a flow reversing valve 101 having a movable valve member 102. The flow reversing valve 101 has a pressure inlet 101*a* connected through a line 103 to the outlet of a hydraulic pump 104 driven by a motor 105. Valve 101 has controlled outlets 101*b* and 101*c* connected through lines 106 and 107 and shut-off valves 108 and 109 to opposite ends of the actuator 43 to reversibly operate the same. Valve member 102 has a pneumatic operator herein shown in the form of a diaphragm 111, with one side of the diaphragm vented to atmosphere through a vent 112 and the other side exposed to the pressure in the diaphragm chamber 113. Air under above atmospheric pressure is supplied as by a blower 116 through the line 117 to a pressure chamber 118 and air from the pressure chamber is supplied through a flow restrictor 119 and line 120 to the diaphragm chamber 113.

The first motion detector 60 is a gap-type pneumatic sensor and air under pressure from the pressure chamber is supplied through a line 125 to the transmitting orifice 63*a*. The sensing orifice 63*b* is connected through a line 126 and shut-off valve 127 to a control chamber 128 that is otherwise connected through line 129 to the diaphragm chamber 113. A valve 131 is connected through a line 132 to the control chamber 128 and through line 129 to the diaphragm chamber 113. Valve 131 is normally closed and is operative, when energized to its open position, to vent the diaphragm chamber 113 to atmosphere. In order to allow free relative movement between the detector body 63 and the main support 51, the conduits 125 and 126 preferably include flexible sections 125*a* and 126*a* formed of a flexible tubing such as soft rubber or the like, and which flexible sections extend between the detector body 63 and the main support 51.

Figure 5:
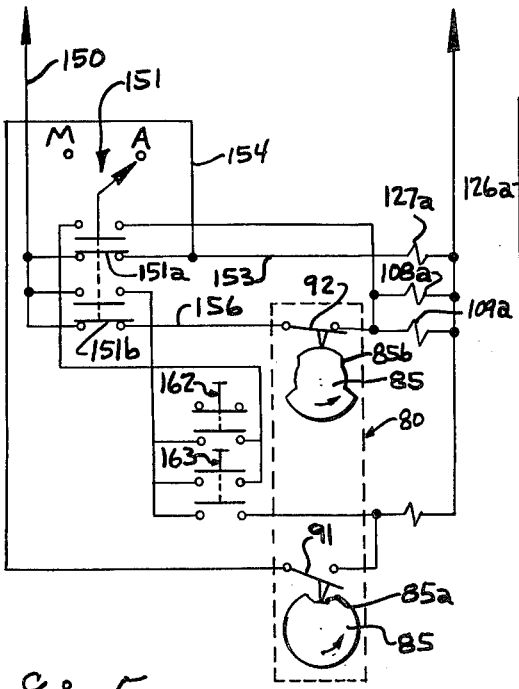
FIG. 5 is a schematic electrical circuit diagram of the web aligning apparatus.

A control circuit for the apparatus is diagrammatically illustrated in FIG. 5. The control circuit includes a mode switch 151 movable between a manual position M and an automatic position A. In the automatic position shown in the drawings, the contact 151*a* of the mode switch is closed to complete a circuit from the power line 150 through line 153 to the electroresponsive operator 127*a* for valve 127, and to also complete a circuit through line 154 to the actuator or switch 91 that controls electroresponsive operator 131*a* for valve 131. Contact 151*b* of the mode switch is also closed in its automatic position to complete a circuit from the power supply conductor 150 through line 156 to the actuator or switch 92 for controlling the electroresponsive operators 108*a* and 109*a* for valves 108 and 109 respectively. The mode switch can also be moved to its manual position to enable manual operation of the apparatus under the control of manually operable "in" and "out" switches 162 and 163.

OPERATIONS

When the mode switch 151 is in its automatic position, the electroresponsive operator 127*a* of normally closed air valve 127 is energized to move the valve to its open position and thereby connect the sensing orifice 63*b* of the first motion detector 60 to the diaphragm chamber 113. In addition, the electroresponsive operators 108*a* and 109*a* of normally closed hydraulic valves 108 and 109 are energized through switch 92 to thereby connect the controlled outlet ports 101*b* and 101*c* of the hydraulic controlled valve 101 to opposite ends of the hydraulic actuator. In addition, in the automatic position of the mode switch, the power is applied to the normally open switch 91 which controls energization of the electroresponsive operator 131*a* of normally closed air valve 131. Thus, when the mode switch is in its automatic mode, air under pressure from the blower 116 is supplied to the transmitting orifice 63*a* and a restricted flow of air from restrictor 119 is simultaneously supplied by way of diaphragm chamber 113 and line 126 to the sensing orifice 63*b*. The transmitting and receiving orifices are elongated in a direction paralleling the direction of movement of the vane 64 and the portion of the air stream from the transmitting orifice that is not interrupted by the vane 64 impinges on the air issuing from the sensing orifice to vary the pressure at the sensing orifice correlative with the position of the movable vane 64. The pressure exerted by a spring 181 on the diaphragm 111 is adjusted as by a screw 182 so that the valve member 102 is in its neutral position shown in FIG. 1 when the vane 64 is in its mid-position only partially blocking the stream of air from the transmitting orifice, as shown in FIG. 3. Further, the sensing head is adjusted along the rod 53 so that the web engaging member 71 engages the pile edge when the pile edge is in the desired position relative to the device D that operates on the web. Thus, as the pile edge moves the pile engaging member laterally outwardly and inwardly from the desired course of travel, it moves the vane 64 to respectively decrease and increase the pressure at the sensing orifice 63*b*. When the pressure at the sensing orifice 63*b* is decreased, the valve member 102 moves downwardly and applies fluid pressure through line 106 and valve 108 to the inner end of the hydraulic actuator 43 to move the device D that operates on the web outwardly and to simultaneously move the web sensing device 41 outwardly until the pile edge is again in proper relation with respect to the device that operates on the web. Conversely, when the pile engaging member moves inwardly to follow the pile edge, the pressure at the sensing orifice is increased and this raises the valve member to apply fluid pressure to the outer end of the actuator 43 and thereby move the device D and the sensor 41 inwardly to follow the pile edge.

Figure 4:
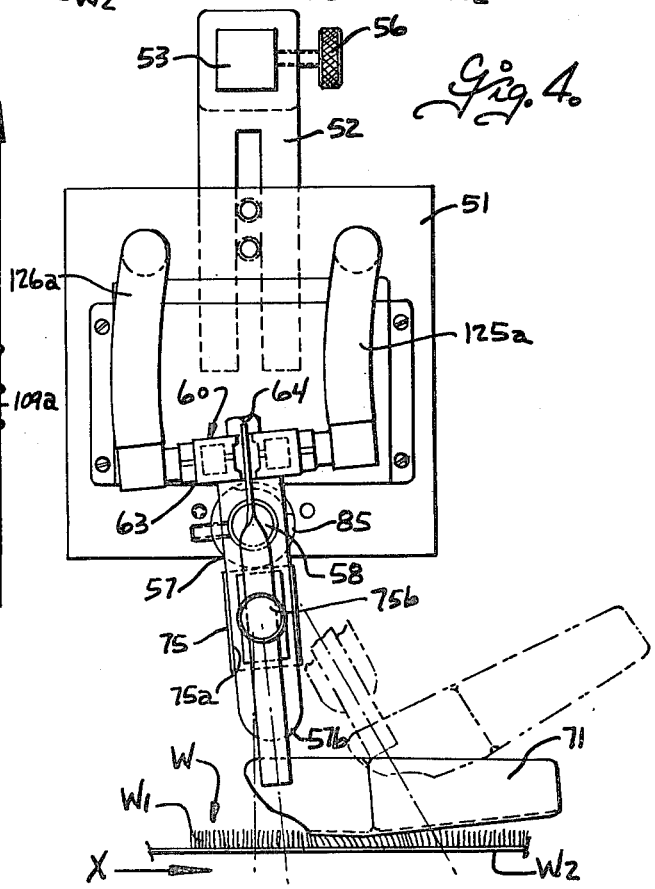
FIG. 4 is a front elevational view of the pile edge sensing apparatus illustrating the parts in different moved positions.

If the web engaging member starts to ride on top of the pile, this will cause the web engaging member 71 to move in an arcuate path from its normal position shown in FIG. 2 to a position such as shown in solid lines in FIG. 4. The first cam means 85*a* on the cam member 85 is arranged to operate the switch 91 when the web engaging member has moved only a slight distance, for example five degrees out of its normal position. When switch 91 is actuated to its closed position, it energizes the electroresponsive operator 131*a* for air valve 131 to move the latter to its open position. This rapidly reduces the pressure in the diaphragm chamber 113 so that the valve member moves down to supply fluid under pressure to the inner end of the hydraulic actuator 43 to thereby move the device D and web sensor 41 in a direction outwardly of the pile edge. As soon as the web engaging member moves off the pile, it returns to its normal position shown in FIG. 2 and allows valve 131 to close so that relative movement between the web and the device that operates thereon is thereafter controlled by the motion detector 60.

When carpets are either butt-seamed or lap-seamed, there is a marked discontinuity in the thickness or height of the carpeting at the seams. Moreover, in such seams, the pile edge of the section that trails is preferably aligned with the pile edge of the preceding section, but is sometimes offset either inwardly or outwardly of the pile edge of the preceding section. Provision is advantageously made for locking the actuator 43 against movement when there is a seam that produces an abrupt and irregular change in the thickness of the web at the sensing location. For this purpose, a second cam surface 85*b* on the cam member 85 is arranged to operate the switch 92, whenever the pile engaging member is moved along the arcuate path beyond a predetermined range, for example beyond thirty degrees from its normal position, as shown in phantom in FIG. 4, and which is indicative of an obstruction or irregularity engaging the web engaging member. Preferably, the primary support 51 is adjusted relative to the bracket 52 to position the lower end 57*b* of the support member 57 at a level such that it extends into the path of travel of a seam in the web, whereby the seam not only engages the web engaging member 71 but also engages the lower end of the support member 57 to cause pivotal movement of the support member about pintle 58. Switch 92 is normally closed so that the electroresponsive operators 108*a* and 109*a* are normally energized to open the hydraulic valves 108 and 109. However, when the web engaging member moves beyond a predetermined range, cam 85*b* allows the switch 92 to open thereby deenergizing the operators 108*a* and 109*a* and allowing the valves 108 and 109 to close to lock the hydraulic actuator against movement. As soon as the obstruction passes the pile engaging member, the pile engaging member can return under the bias of spring 83 toward its normal position. If the pile edge on the trailing section is aligned with the pile edge on the preceding section, the pile engaging member will move all the way back to its normal position shown in FIG. 2 and guiding of the web will be under the control of the first motion sensor 60. However, if the pile edge on the trailing section is offset outwardly of the preceding section, the pile engaging member will ride on top of the pile and only move part way back to its normal position after the obstruction passes so that the cam 85*a* will close switch 91 to move the web and the device D in a direction laterally outwardly of the pile edge. On the other hand, if the pile edge on the trailing section is offset inwardly relative to the preceding section, the web engaging member will return to its normal position shown in FIG. 2, but will be retracted by springs 88 in a direction laterally inwardly so that the sensor 63 will apply a signal to operate actuator 43 in a direction to move the device D and web in a direction inwardly toward the pile edge.

It will thus be seen that the first motion detector only detects movement of the pile engaging member produced by lateral deviations of the pile edge from the desired course of travel, and that the second motion detector 80 detects movement of the pile engaging member produced when it rides on top of the pile. An additional motion detecting means comprising the cam surface 85*b* detects when the pile engaging member is engaged by sharp discontinuity such as a seam in the web. This arrangement wherein the pile engaging member is movable along a path tangent to the web and in the direction of movement of the web, when it either rides on top of the pile or is engaged by a seam in the web allows the pile engaging member to yield in the direction of travel of the web so that it is not likely to be damaged when contacted by a transverse seam or other discontinuity in the web. Since the pile engaging member is mounted for rectilinear movement on the sensor support 57, movement of the pile engaging member along its first path is not affected by whether the pile sensor is upright, vertical or inverted at the sensing location. The pivotal mounting of the sensor mounting member 57 to allow movement of the pile engaging member along its second path, is such that the effects of gravity on the mounting member in different positions of the sensor, can be readily compensated by adjustment of the spring 83. Thus, the pile edge sensor 41 is not only adapted for sensing the pile edge at locations where the web is traveling generally horizontally with the pile at the top, but also at locations where the web is traveling in a more or less vertical plane and also where the web is inverted with the pile extending downwardly.

The embodiments of the invention in which an exclusive property or privilege is claimed are defined as follows:

1. A web aligning apparatus for use with multi-level web material having a backing and a pile on the backing inwardly of the edge of the latter to maintain the pile edge in a preselected lateral position relative to a device that operates on the web, the web aligning apparatus including a main support adapted to be mounted at a sensing location along the course of travel of the web, a secondary support member mounted on the main support for pivotal movement relative thereto about an axis crosswise of the course of travel of the web and generally parallel to and spaced from the face of the web at the sensing location, a pile engaging member adapted to engage the pile edge, means mounting the pile engaging member on said secondary support member for movement relative thereto only along a first path crosswise of the course of travel of the web and generally parallel to the face of the web at the sensing location to sense movement of the pile edge laterally of the course of travel of the web, said pile engaging member being supported by said secondary support member for movement therewith about said pivot axis in a second arcuate path generally tangent to the course of travel of the web from a first position alongside the web backing at said sensing location toward a second position displaced along said arcuate path in the direction of travel of the web when the pile engaging member rides on top of the pile, a first motion detector for detecting movement of the pile engaging member along said first path, said first motion detector including a detector body mounted on the secondary support member for movement therewith about said pivot axis and a movable detector member connected to said pile engaging member and movable relative to said detector body for providing a signal correlative in amplitude with the position of the pile engaging member along said first path, power means for effecting relative shifting of the web and the device that operates on the web, a first control means responsive to the signal provided by said first motion detector for operating the power means to maintain the pile edge in a preselected lateral position relative to the device that operates on the web, a second motion detector for sensing movement of said pile engaging member along said second arcuate path, and additional control means responsive to said second motion detector means for operating the power means to relatively shift the web and the device that operates on the web in a direction to cause the pile engaging member to move outwardly of the pile on the web.

2. A web aligning apparatus according to claim 1 wherein said means mounting said pile engaging member on said secondary support member includes rectilinear guide means paralleling said pivot axis and slidably and non-rotatably mounting the pile engaging member on the secondary support member.

3. A web aligning apparatus according to claim 2 wherein said rectilinear guide means comprises a pair of parallel guide rods connected to the pile engaging member and anti-friction bearings supporting said rods on the secondary support member.

4. A web aligning apparatus according to claim 1 including fault detecting means responsive to movement of said pile engaging member along said arcuate path through a distance in excess of a preselected distance for preventing the power means for effecting relative shifting of said web and the device that operates on the web.

5. A web aligning apparatus according to claim 1 wherein said second motion detector includes a cam means responsive to turning of said secondary support member about said pivot axis.

6. A web aligning apparatus according to claim 1 wherein said second motion detector includes a first cam means responsive to turning of said secondary support member about said pivot axis through a preselected range from said first position of said web engaging member, a third motion detector including a second cam means responsive to turning of said secondary support member about said pivot axis through a distance in excess of said preselected range, said means operated by said third motion detector for preventing the power means from effecting relative shifting of the web and the device that operates on the web.

7. A web aligning apparatus according to claim 1 wherein said first motion detecting means includes a gap-type pneumatic sensor having a transmitting orifice and a sensing orifice and said movable detector member comprises a vane movable in the gap between the transmitting orifice and the sensing orifice.

8. In a web aligning apparatus for use with multi-level web material having a backing and a pile edge on the backing inwardly of the edge of the latter to maintain the pile edge in a preselected lateral position relative to a device that operates on the web, a support member adapted to be mounted at a sensing location along the course of travel of the web, a pile engaging member adapted to engage the pile edge, means mounting the pile engaging member on the support member for movement relative thereto along a first path cross-wise of the course of travel of the web and generally parallel to the face of the web at the sensing location, a motion detector for detecting movement of the pile engaging member along said first path, said motion detector including a detector body mounted on the support member and a movable detector member connected to the pile engaging member and movable relative to the detector body for providing a signal correlative in amplitude with the position of the pile engaging member along said first path, power means for effecting relative shifting of the web and the device that operates on the web, and control means responsive to the signal provided by the motion detector for operating the power means to maintain the pile edge in a preselected lateral position relative to the device that operates on the web, the improvement wherein said support member is mounted on a main support for pivotal movement relative thereto about an axis crosswise of the course of travel of the web and generally parallel to and spaced from the web at the sensing location whereby said pile engaging member can move about said pivot axis in an arcuate path generally tangent to the course of travel of the web at the sensing location from a first position alongside the web backing at the sensing location toward a second position displaced along the arcuate path in the direction of travel of the web when the pile engaging member rides on top of the pile, a second motion detector for detecting movement of said pile engaging member along said arcuate path, and additional control means responsive to said second motion detector for operating the power means to relatively shift the web and the device that operates on the web in a direction to cause the pile engaging member to move outwardly of the pile on the web.

9. A web aligning apparatus according to claim 8 including fault detecting means responsive to movement of said pile engaging member along said arcuate path through a distance in excess of a preselected distance for preventing the power means from effecting relative shifting of said web and the device that operates on the web.

10. A web aligning apparatus according to claim 9 wherein said second motion detector and said fault detecting means include cam means responsive to movement of said support member about said pivot axis.

11. A web aligning apparatus according to claim 8 wherein said means mounting said pile engaging member on said support member includes rectilinear guide means paralleling said pivot axis and slidably and non-rotatably mounting the pile engaging member in the support member.

12. A web aligning apparatus according to claim 8 wherein said motion detector for detecting movement of the pile engaging member along the first path includes a gap-type pneumatic sensor having a transmitting orifice and a sensing orifice and said movable detector member comprises a vane movable in said gap.

* * * * *